US007106994B2

(12) United States Patent
Kim

(10) Patent No.: US 7,106,994 B2
(45) Date of Patent: Sep. 12, 2006

(54) METHOD OF PREVENTING FLOW PATTERN IN WET-TYPE COLOR IMAGE FORMING APPARATUS AND SYSTEM ADOPTING THE SAME

(75) Inventor: Wan-ha Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/282,217

(22) Filed: Oct. 29, 2002

(65) Prior Publication Data

US 2003/0156857 A1 Aug. 21, 2003

(30) Foreign Application Priority Data

Feb. 19, 2002 (KR) ..... 2002-8758

(51) Int. Cl.
*G03G 15/10* (2006.01)
*G03G 15/00* (2006.01)

(52) U.S. Cl. ..... 399/237; 399/159

(58) Field of Classification Search ..... 399/159, 399/237; 430/66, 117
See application file for complete search history.

(56) References Cited

U.S. PATENT DOCUMENTS 5,059,501 A * 10/1991 Yagi et al. ..... 430/66
5,374,980 A * 12/1994 Kubo et al. ..... 399/237
5,534,978 A * 7/1996 Nakamura et al.
5,656,405 A * 8/1997 Tsushima
5,998,075 A * 12/1999 Fujiwara et al.
6,029,034 A * 2/2000 Itsukushima et al. ..... 399/159
6,183,933 B1 * 2/2001 Ishikawa et al.
6,556,802 B1 * 4/2003 Sasamoto et al.
2001/0031411 A1 * 10/2001 Kojima et al. ..... 399/159

FOREIGN PATENT DOCUMENTS

JP 01263660 A * 10/1989
JP 02167558 A * 6/1990

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A method of preventing a flow pattern in a wet-type color image forming apparatus and a system adopting the same includes a material layer directly contacting a developing roller of a developing unit of a photosensitive body of the image forming apparatus and having a thickness of 7–15 μm. A size of an essential composition used for representing corresponding one of colors in high-concentration ink is 0.7–1.5 μm. A hold up volume is not formed between the developing roller and the photosensitive body during a developing process, and a flow pattern such as a stripe, is not formed in a final image, and even though the flow pattern is formed in the final image, the flow pattern can be minimized.

9 Claims, 6 Drawing Sheets

METHOD OF PREVENTING FLOW PATTERN IN WET-TYPE COLOR IMAGE FORMING APPARATUS AND SYSTEM ADOPTING THE SAME

CROSS-REFERENCE TO RELATED APPLICATIONS

This application claims the benefit of Korean Patent Application No. 2002-8758, filed Feb. 19, 2002, in the Korean Industrial Property office, the disclosure of which is incorporated herein by reference.

BACKGROUND OF THE INVENTION

1. Field of the Invention

The present invention relates to an image forming apparatus and a method of using the same, and more particularly, to a wet-type color image forming apparatus and a method of preventing a flow pattern of an ink image using the same.

2. Description of the Related Art

As there is a need of reducing a size of a wet-type color image forming apparatus, a method of removing a developing solution supply unit or simplifying a structure of the wet-type color image forming apparatus has been suggested to reduce the size of the wet-type color image forming apparatus. As a result, ink having toner concentration of more than 12% is not diluted but is used as is without change.

In the related art, a developing process using the high-concentration ink is performed using a direct contact method in which a developing roller contacts a photosensitive body. In the direct contact method, preferably, the high-concentration ink stained in the developing roller is completely used for developing a latent electrostatic image that is formed on the photosensitive body. However, remaining ink that is not completely used for developing the latent electrostatic image but drifts away exists between the photosensitive body and the developing roller in the developing process, and the remaining ink accumulates, as shown in FIG. 1. A hold up volume 16, which is a bundle of the remaining ink, is formed between a developing roller 12 and a photosensitive body 10. The hold up volume 16 might be used to develop the latent electrostatic image with ink 14 that is newly supplied in the developing process.

However, since the ink 14 forming the hold up volume 16 is not be electrically controlled in comparison with new ink 14 having an electrical potential, the ink 14 forming the hold up volume 16 is moved to the photosensitive body 10, and then drops downward immediately. As a result, a part of the latent electrostatic image may be not developed or incompletely developed. In addition, a part of the ink 14 that is normally moved to the photosensitive body 10 from the developing roller 12 is torn off and separated from the ink 14 by a viscous force of the remaining ink 14 contained in the developing roller 12. Due to the separation of the ink 14, the part of the latent electrostatic image is not developed or incompletely developed. A metering blade 18 coats the ink 14 having a predetermined thickness on a surface of the developing roller 12.

As mentioned above, in order to avoid to the remaining ink 14 contained in the hold up volume 16 or the developing roller 12, high-concentration ink is used. However, a stripe so-called a flow pattern is formed in a developing direction when the photosensitive body 10 directly contacts the developing roller 12. Due to the flow pattern, a final resultant (image) is formed in a solid phenomenon, in which an excessive amount of the ink 14 is attached to an image portion more than a blank portion of the latent electrostatic image, in the developing direction.

The flow pattern is completely removed when the ink prepared on the surface of the developing roller is completely used for developing the latent electrostatic image in the developing process. That is, in a case where the ink prepared on the surface of the developing roller is moved to the photosensitive body, the remaining ink disappears from the surface of the developing roller, and the hold up volume is not formed between the developing roller and the photosensitive body, and thus the flow pattern does not to exist in the developed latent electrostatic image.

However, to do this, an amount of the ink prepared on the surface of the developing roller should be minimized. In a case where the amount of the ink is minimized, an optical density of the developed resultant deteriorates, and thus a final image fades.

SUMMARY OF THE INVENTION

To solve the above and other problems, it is an object of the present invention to provide a wet-type color image forming apparatus which is capable of normally maintaining a concentration of a final resultant in a developing process using high-concentration ink, and preventing a flow pattern from being formed in the resultant or minimizing the flow pattern even though the flow pattern is formed in the resultant.

It is another object of the present invention to provide a method of preventing a flow pattern using the wet-type color image forming apparatus.

Additional objects and advantageous of the invention will be set forth in part in the description which follows and, in part, will be obvious from the description, or may be learned by practice of the invention.

Accordingly, to achieve the above and other objects, there is provided a wet-type color image forming apparatus in which latent electrostatic images corresponding to external input data or manuscript are formed. The wet-type color image forming apparatus includes photosensitive bodies in which the latent electrostatic images are developed by high-concentration ink supplied from a developing unit. Each of the photosensitive bodies includes a solid center body and a contour layer surrounding a circumference of the center body. A material layer of the contour layer contacting the developing unit is a flow pattern-prevention layer having a predetermined thickness so that a flow pattern is not formed in a developed latent electrostatic image.

Here, the contour layer includes an adhesion layer and a charge layer, which sequentially surround the center body, and the flow pattern-prevention layer which surrounds the charge layer. The center body is an aluminum drum. A size of an essential composition used for representing a color in the high-concentration ink is 0.7–1.5 μm. The flow pattern prevention layer is an over-coating layer having a thickness of 7–15 μm.

In order to achieve the above and other objects, there is provided a method of preventing the flow pattern in the wet-type color image forming apparatus in which the latent electrostatic images corresponding to the external input data or manuscript are formed. The wet-type color image forming apparatus includes the photosensitive bodies on which the latent electrostatic images are developed by the high-concentration ink supplied from the developing unit. The flow pattern-prevention layer having a predetermined thickness is used as a material layer of the contour layer contacting the developing unit.

In the present invention, the over-coating layer having a thickness of 7–15 μm is used as the flow pattern-prevention layer. The latent electrostatic images are developed using the high-concentration ink having an essential composition having a size of 0.7–1.5 μm.

According to an aspect of the present invention, a hold up volume is not formed between a developing roller and the photosensitive body in a developing process, thereby preventing the flow pattern like a stripe in a final image.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
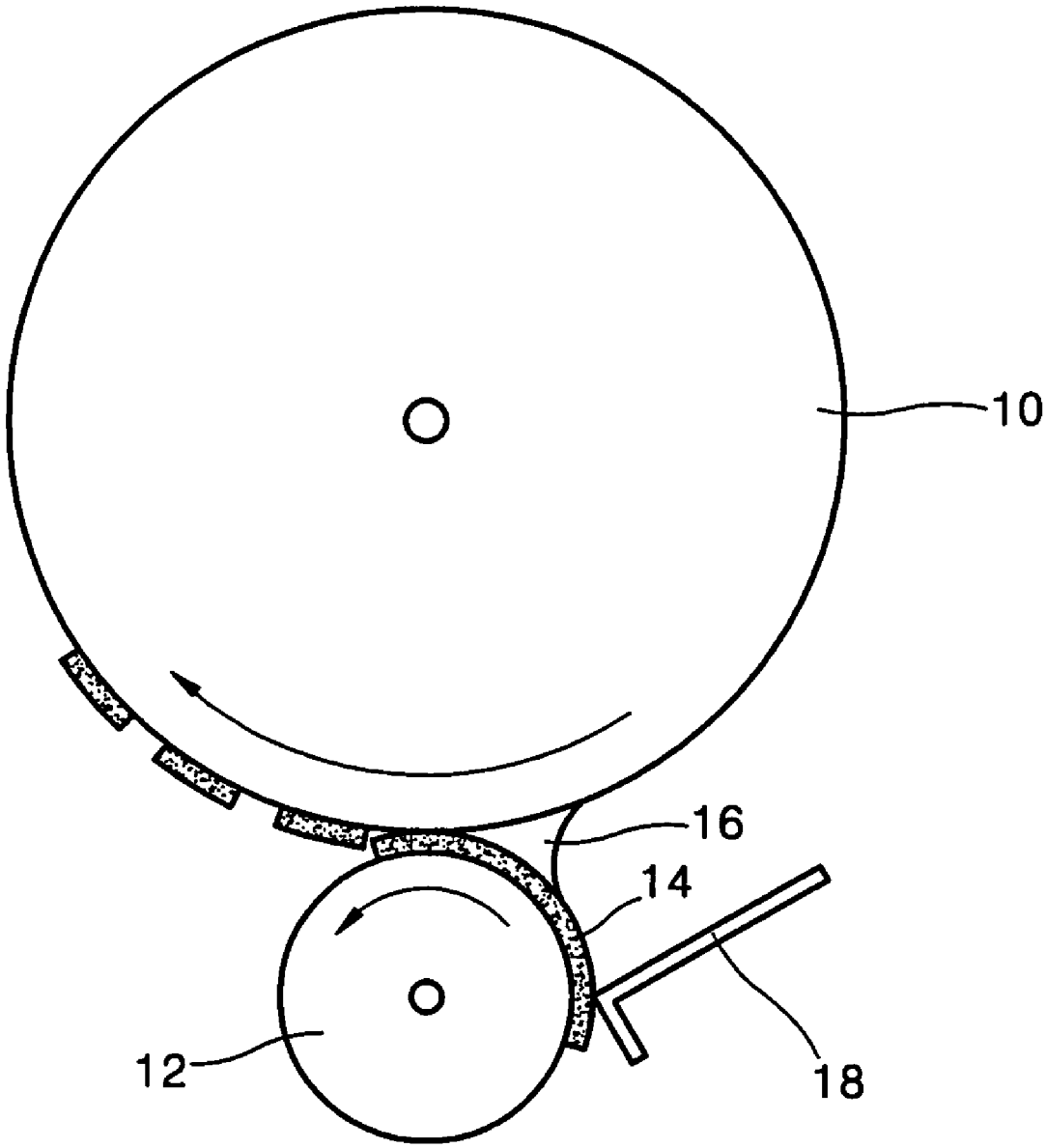
FIG. 1 (PRIOR ART)
FIG. 1 illustrates a developing process of a conventional wet-type color image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, embodiments of the present invention will be described in detail with reference to the accompanying drawings.

The present invention provides a new thickness of a skin layer of a photosensitive body and a new size of pigment, which is an essential composition of a developing agent (high-concentration ink). The present invention is achieved using the photosensitive body and the developing agent.

First, the new thickness of the skin layer of the photosensitive body will be described below. Then, the new size of pigment will be described. The wet-type color image forming apparatus including the photosensitive body according to an embodiment of the present invention will be described below.

Figure 2:
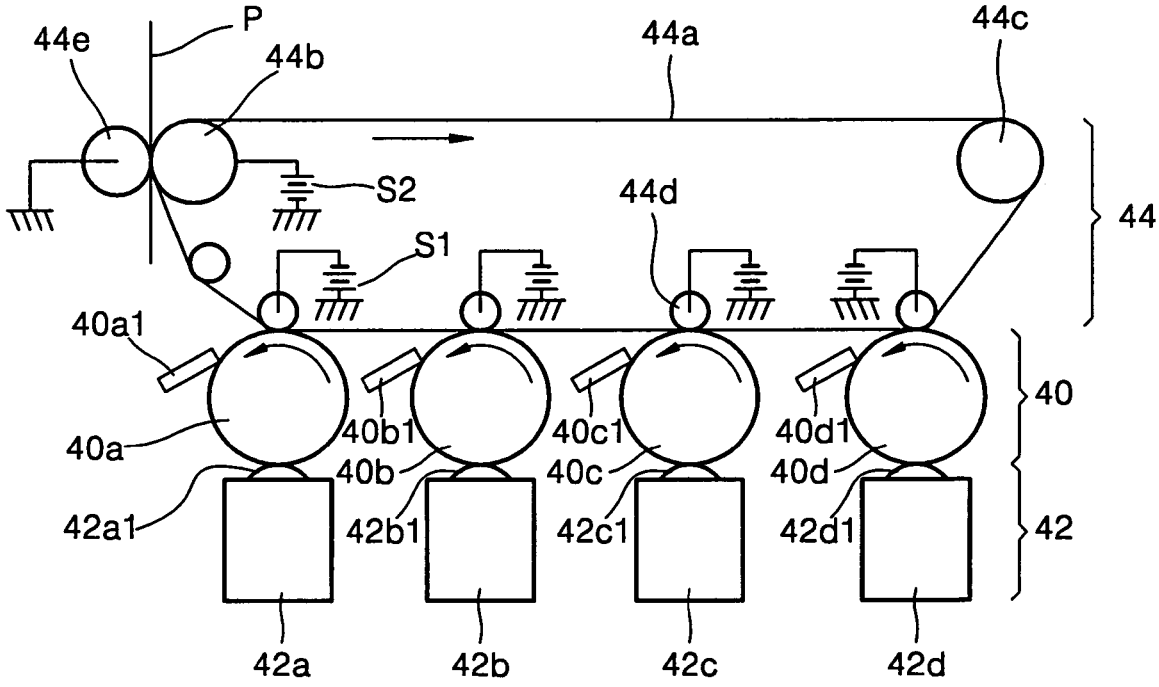
FIG. 2 is a cross-sectional view illustrating a structure of a wet-type color image forming apparatus according to an embodiment of the present invention.

Specifically, as shown in FIG. 2, the wet-type color image forming apparatus includes a photosensitive body portion 40, a developing unit portion 42, and a transfer portion 44. The apparatus further includes paper feeding and delivery portions and a developing cartridge disposed under the developing unit portion 42 supplying the developing agent to the developing unit portion 42.

The photosensitive body portion 40 includes first through fourth photosensitive bodies 40*a*, 40*b*, 40*c*, and 40*d*, which are spaced-apart from one another at a predetermined interval. The first through fourth photosensitive bodies 40*a*, 40*b*, 40*c*, and 40*d* are formed with a latent electrostatic image corresponding to images for each color and are a black (K) photosensitive body on which a latent electrostatic image corresponding to a black image is formed, a cyan (C) photosensitive body on which a latent electrostatic image corresponding to a cyan image is formed, a magenta (M) photosensitive body on which a latent electrostatic image corresponding to a magenta image is formed, and a yellow (Y) photosensitive image on which a latent electrostatic image corresponding to a yellow image is formed. Reference numerals 40*a*1, 40*b*1, 40*c*1, and 40*d*1 denote first through fourth cleaning blades, which contact and clean the first through fourth photosensitive bodies 40*a*, 40*b*, 40*c*, and 40*d*, respectively.

After the developed latent electrostatic image excluding the first through fourth cleaning blades 40*a*1, 40*b*1, 40*c*1, and 40*d*1 is transferred, an eraser neutralizes a charge state of the first through fourth photosensitive bodies 40*a*, 40*b*, 40*c*, and 40*d*, a charger charges a surface of the first through fourth photosensitive bodies 40*a*, 40*b*, 40*c*, and 40*d*, which are neutralized before a new latent electrostatic image is formed, and a laser scanning unit scans light onto the surface of the first through fourth charged photosensitive bodies 40*a*, 40*b*, 40*c*, and 40*d* to form the new latent electrostatic image. The eraser, the charger, and the laser scanning unit are disposed around corresponding ones of the first through fourth photosensitive bodies 40*a*, 40*b*, 40*c*, and 40*d*.

The developing unit portion 42 disposed under the photosensitive body portion 40 includes first through fourth developing units 42*a*, 42*b*, 42*c*, and 42*d*, which correspond to respective ones of the first through fourth photosensitive bodies 40*a*, 40*b*, 40*c*, and 40*d* and supply a corresponding color developing agent used to develop latent electrostatic images formed on the first through fourth photosensitive bodies 40*a*, 40*b*, 40*c*, and 40*d*. Reference numerals 42*a*1, 42*b*1, 42*c*1, and 42*d*1 denote first through fourth developing rollers, which contact respective ones of the first through fourth photosensitive bodies 40*a*, 40*b*, 40*c*, and 40*d* and supply a color developing agent to the first through fourth photosensitive bodies 40*a*, 40*b*, 40*c*, and 40*d*, respectively. The transfer portion 44 includes a transfer belt 44*a*, rollers 44*b*, 44*c*, and 44*d*, which drive the transfer belt 44*a* and maintain the transfer belt 44*a* in a given form, and a paper transfer roller 44*e*, which rotates together with one of the rollers 44*b*, 44*c*, and 44*d* to transfer a developed resultant (image) from the transfer belt 44*a* onto paper P.

The transfer belt 44*a* contacts the first through fourth photosensitive bodies 40*a*, 40*b*, 40*c*, and 40*d*, and a transfer backup roller 44*d* is included within the transfer portion 44 and supports a portion of the transfer belt 44*a* contacting the first through fourth photosensitive bodies 40*a*, 40*b*, 40*c*, and 40*d*, so as to transfer the developed resultants (images) developed from the first through fourth photosensitive bodies 40*a*, 40*b*, 40*c*, and 40*d*, onto the transfer belt 44*a*. The developed resultants of the first through fourth photosensitive bodies 40*a*, 40*b*, 40*c*, and 40*d* precisely overlap on a predetermined location of the transfer belt 44*a* and are transferred from the transfer belt 44*a* to the paper P.

The rollers 44*b*, 44*c*, and 44*d* disposed within the transfer belt 44*a* support the paper transfer roller 44*e* and transfer the developed resultants onto the paper P, and a high voltage can be supplied to the rollers 44*b*, 44*cc*, and 44*d*. The paper transfer backup roller 44*b* transfers the resultants developed by an electric force onto the paper P, and the driver roller 44*c* drives the transfer belt 44*a* so that the developed resultants precisely overlap on the predetermined location of the transfer belt 44*a* and are transferred onto the transfer belt 44*a* from the photosensitive body portion 40, and the developed resultants are precisely transferred onto the paper P from the transfer belt 44*a*.

The first through fourth photosensitive bodies 40*a*, 40*b*, 40*c*, and 40*d* are photosensitive drums charged with a positive voltage during a charge process, and a developing agent supplied from the first through fourth developing units 42*a*, 42*b*, 42*c*, and 42*d*, that is, high-concentration ink, has the positive charge. Thus, it is necessary to supply a negative voltage to the transfer backup roller 44*d* so that the developed resultants formed in each photosensitive body overlap on the predetermined location of the transfer belt 44*a* and are transferred onto the transfer belt 44*a*. To do this, a power source S1 supplying the negative voltage to the transfer backup roller 44*d* is connected to the transfer backup roller 44*d*.

Since the first through fourth photosensitive bodies 40*a*, 40*b*, 40*c*, and 40*d* are still charged with the positive voltage after the color images have been transferred onto the transfer belt 44*a*, it is possible that the color images are easily transferred onto the paper P from the transfer belt 44*a* by supplying the positive voltage to the paper transfer backup roller 44*b*. To do this, a power source S2 supplying the positive voltage to the paper transfer backup roller 44*b* is connected to the paper transfer backup roller 44*b*.

Figure 3:
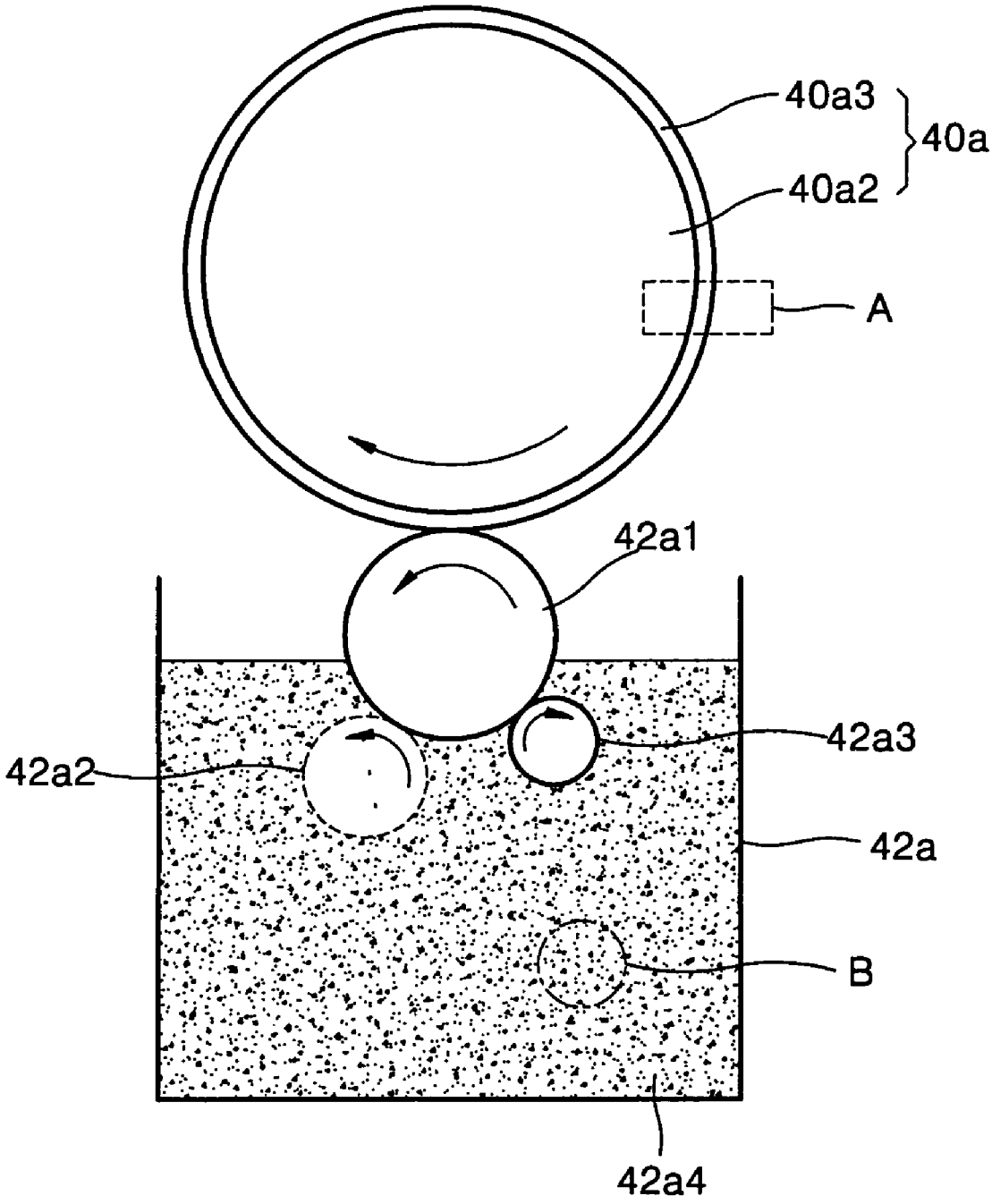
FIG. 3 is a cross-sectional view illustrating a photosensitive body and a developing unit of the wet-type color image forming apparatus shown in FIG. 2.

Referring to FIG. 3, the first photosensitive body 40*a* includes a solid center body 40*a*2 and a contour layer 40*a*3 surrounding a circumference of the center body 40*a*2. The first developing unit 42*a* includes a first developing roller 42*a*1, and a lower portion of the first developing roller 42*a*1 is sunk in ink 42*a*4. The first developing unit 42*a* further includes a cleaning brush roller 42*a*2 cleaning the first developing roller 42*a*1 and a deposit roller 42*a*3 electrically supplying the ink 42*a*4 to a surface of the first developing roller 42*a*1, and the cleaning brush roller 42*a*2 and the deposit roller 42*a*3 are completely sunk in the ink 42*a*4. The center body 40*a*2 of the first photosensitive body 40*a* has a cylindrical shape having a circular section and a predetermined length and is a solid drum such as an aluminum drum.

Figure 4:
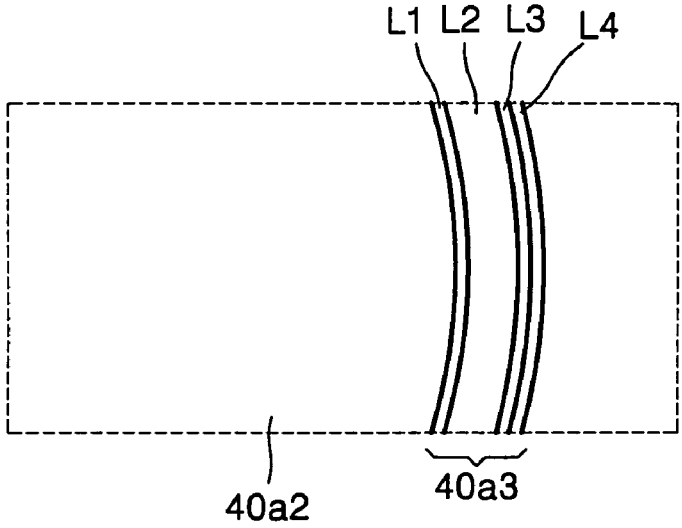
FIG. 4 is a cross-sectional view of a part A shown in FIG. 3.

Referring to FIG. 4 showing an enlarged view of a part A of FIG. 3, the contour layer 40*a*3 includes first through fourth material layers L1, L2, L3, and L4. The first through fourth material layers L1, L2, L3, and L4 are an adhesion layer, a charge transfer layer, a charge generating layer, and an over-coating layer, respectively. The adhesion layer L1 attaches the charge transfer layer L2 to the solid drum 40*a*2, and the charge transfer layer L2 transfers a charge to the solid drum 40*a*2 from the charge generating layer L3 when the charge is erased or the latent electrostatic images are formed, and the charge generating layer L3 is charged with the charge by a charger. The over-coating layer L4, which is the fourth material layer of the contour layer 40*a*3, is an outermost layer of the contour layer 40*a*3, directly contacts the first developing roller 42*a*1 during the developing process, has a predetermined resistance, and prevents the charge generating layer L3 from being damaged when the photosensitive body 40*a* is cleaned. As the over-coating layer L4 becomes thicker, the resistance of the photosensitive body 40*a* increases.

A thickness of the over-coating layer L4 in the photosensitive body 40*a* used in the wet-type color image forming apparatus is about 25–35 μm, and I have contemplated that a flow pattern is formed due to the thickness of the over-coated layer L4 through interpretation and experiments and that the flow pattern can be prevented or minimized by varying the thickness of the over-coating layer L4. That is, I noticed that when an image is formed using the photosensitive body 40*a* having a thickness less than 25 μm of the over-coating layer L4, a hold up volume, which is formed between the photosensitive body 40*a* and the first developing roller 42*a*1 in a conventional image forming apparatus decreases as the over-coating layer L4 becomes thinner. When the thickness of the over-coating layer L4 is about 15 μm, the hold up volume disappears without affecting the cleaning of the photosensitive body 40*a*, and this result is maintained in an optimum state until the thickness of the over-coating layer L4 is about 7 μm.

Consequently, the flow pattern is not formed without affecting image forming processes, such as a cleaning process of the photosensitive body 40*a*, when the thickness of the over-coating layer L4 of the photosensitive body 40*a* is 7–15 μm. Thus, the over-coating layer L4 prevents the flow pattern from being formed to a predetermined thickness.

Figure 6:
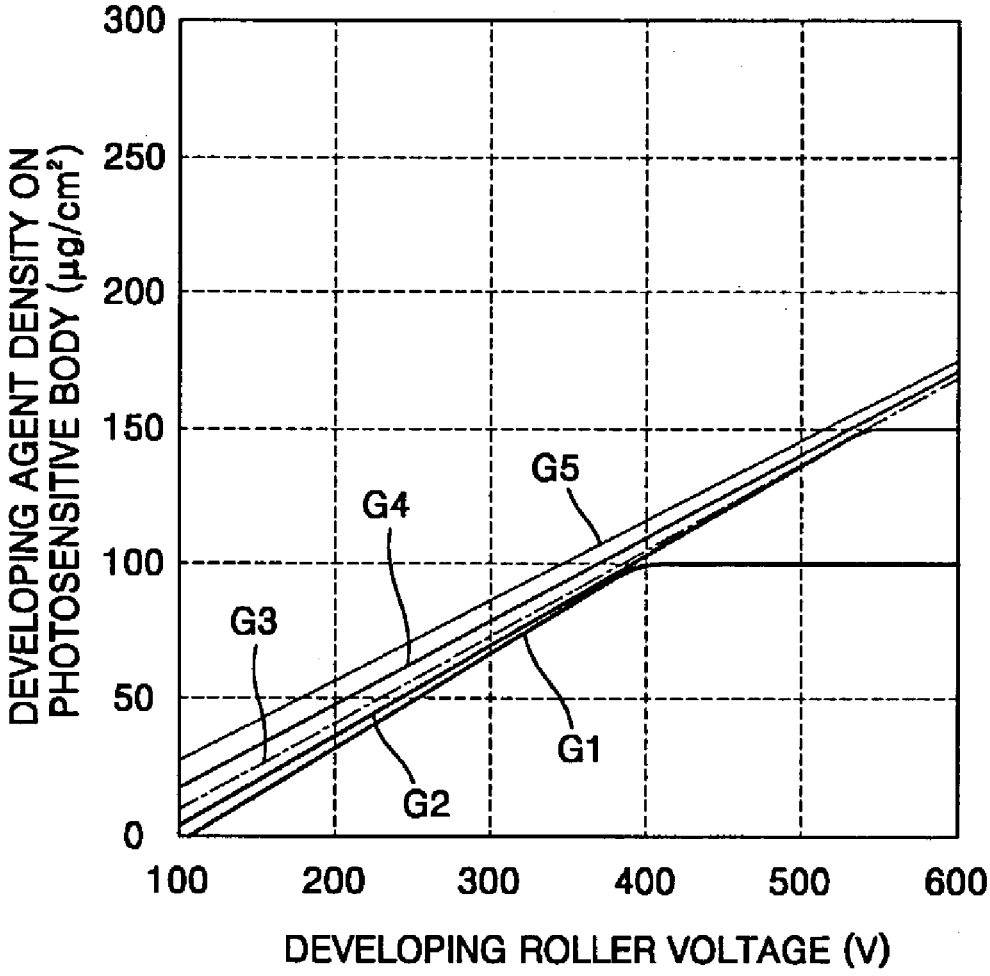
FIG. 6 (PRIOR ART)
FIGS. 6 and 7 are graphs illustrating variations in an optical density of a developing agent, which is transferred onto a surface of the photosensitive body according to a voltage supplied to a developing roller, in the wet-type color image forming apparatus according to prior art and the present invention, respectively.
Figure 7:
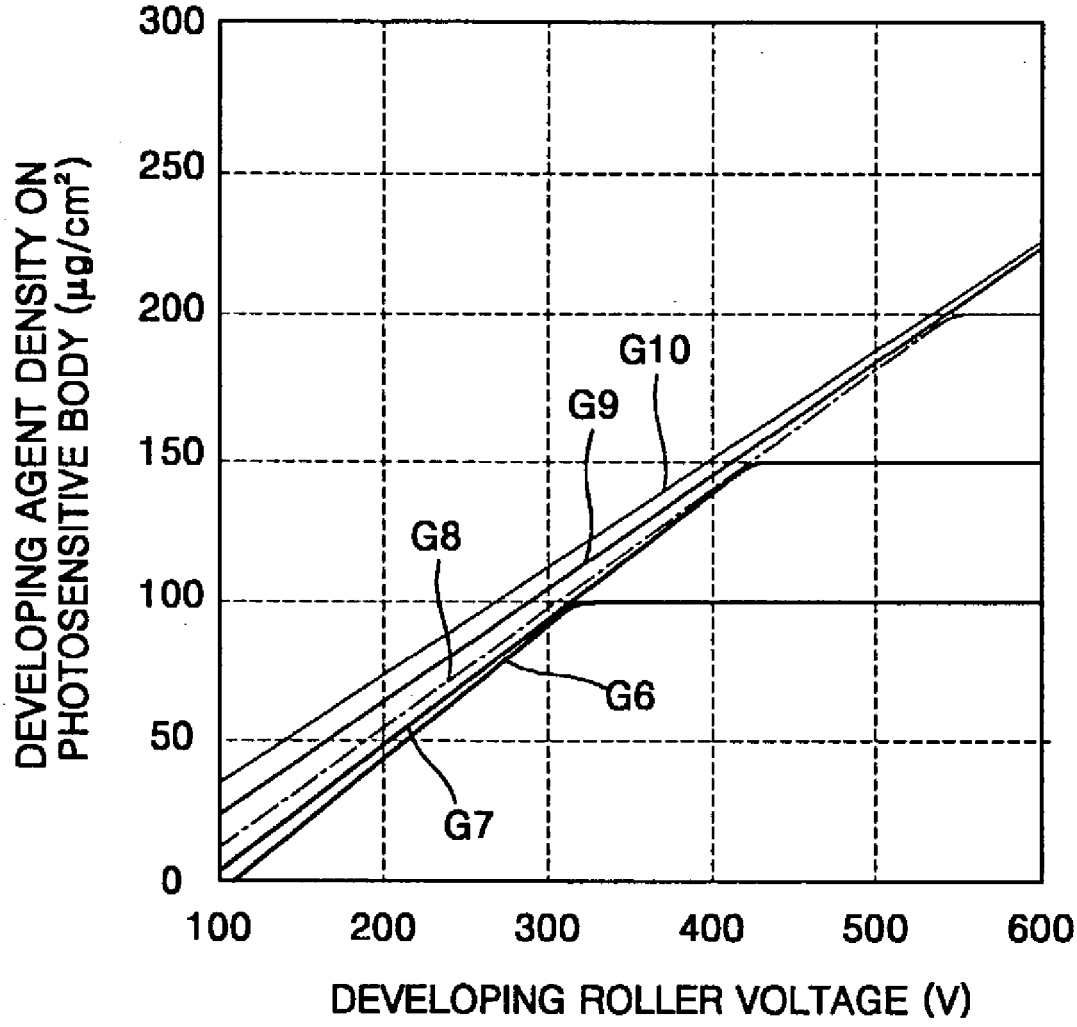

FIGS. 6 and 7 are graphs illustrating a result of interpretation of a developing efficiency according to variations in thickness of the over-coating layer L4 when an amount of charge per weight of the developing agent is about 200 μC/g. A longitudinal axis shown in FIGS. 6 and 7 represents a voltage supplied to the first developing roller 42*a*1, and a latitudinal axis shown in FIGS. 6 and 7 represents weight per area of the developing agent transferred onto the photosensitive body 40*a* from the first developing roller 42*a*1 during the developing process. FIG. 6 illustrates a case where the thickness of the over-coating layer L4 is 25–35 μm, and FIG. 7 illustrates a case where the thickness of the over-coating layer L4 is 7–15 μm. Reference numerals G1 through G10 shown in FIGS. 6 and 7 denote first through tenth graphs illustrating the result of interpretation of the developing efficiency when the weight of the developing agent per area of the developing roller is 100, 150, 200, 250, and 300 $\mu g/cm^2$, respectively. The slopes of the first through tenth graphs are not different, and thus the same variations are shown.

As a result, compared the first through fifth graphs G1, G2, G3, G4, and G5 with the sixth through tenth graphs G6, G7, G8, G9, and G10, when the thickness of the over-coating layer L4 is 7–15 μm, an excess amount of the developing agent is transferred onto the photosensitive body from the developing roller, and thus the developing efficiency is increased than when the thickness of the over-coating layer is 25–35 μm. For example, compared with the third graph G3 with the eighth graph G8, when a voltage supplied to the developing roller is about 400V, the amount of the developing agent transferred onto the photosensitive body is about 100–110 $\mu g/cm^2$ in the third graph G3, and the amount of the developing agent transferred onto the photosensitive body is more than 130 $\mu g/cm^2$ in the eighth graph G8.

In order to verify the result of this experiment, images are formed using a conventional photosensitive body having the over-coating layer L4 having a thickness of about 25 μm, and a photosensitive body having the over-coating layer L4 having a thickness of about 15 μm according to the present embodiment. In a case where the images formed using the conventional photosensitive body are called first images, and where the images formed using the photosensitive body according to the present embodiment are called second images, the flow pattern does not appear in the second images but appears in the first images.

This verification shows that the flow pattern is not formed when the thickness of the over-coating layer L4 of the photosensitive body 40*a* is about 7–15 μm according to the present embodiment.

The above description of the thickness of the over-coating layer of the photosensitive body can be implemented to the first photosensitive body 40*a* and the second through fourth photosensitive bodies 40*b*, 40*c*, and 40*d*.

Figure 5:
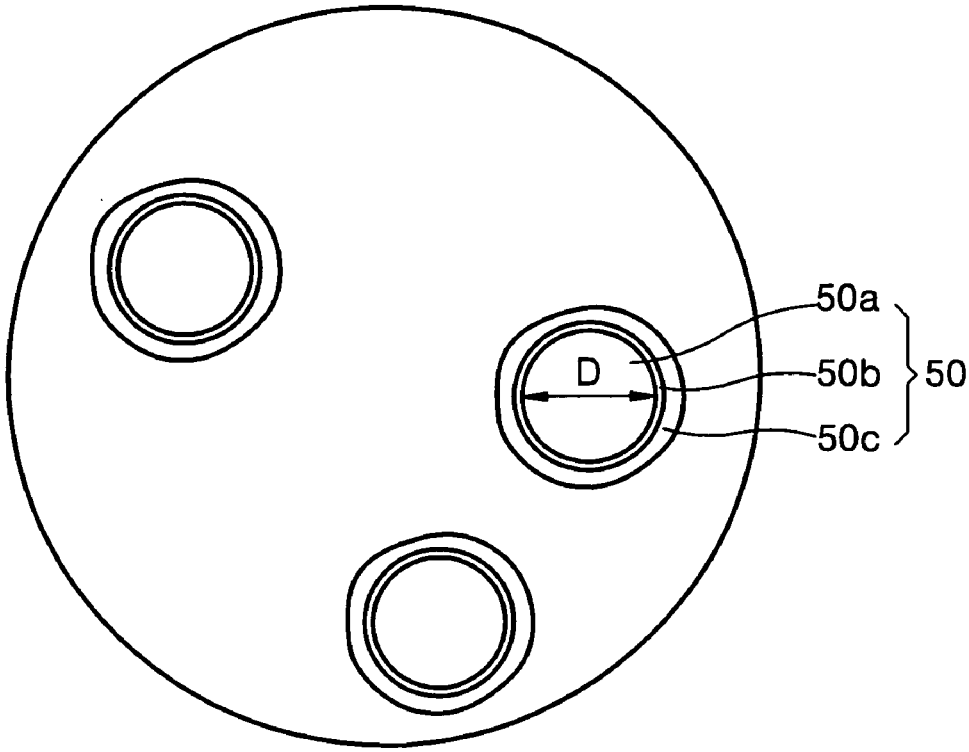
FIG. 5 is a cross-sectional view of a part B shown in FIG. 3 and illustrates a structure of a basic composition of high-concentration ink used in the wet-type color image forming apparatus shown in FIG. 2.

FIG. 5 illustrates a part B of the high-concentration ink 42*a*4 shown in FIG. 3. A basic composition 50 of the high-concentration ink 42*a*4 as the developing agent includes a pigment 50*a*, which is an essential composition representing one of colors of images, a free core layer 50*c*, which is formed around the pigment 50*a* and has a predetermined amount of charge to move the pigment 50*a* to a surface of the first developing roller 42*a*1, and an organosol layer 50*b*, which combine the pigment 50*a* with the free core layer 50*c*. A shape of the pigment 50*a* does not necessarily have a circular section. However, as an example, the shape of the pigment 50*a* having a circular section will be described below.

As described above in the present invention and based on another experiment, the flow pattern is not formed by setting the thickness of the over-coating layer 40*a*3 of the first photosensitive body 40*a* and by setting the size of the pigment 50*a*, that is, the size of a toner.

That is, in the present invention, the flow pattern is minimized without affecting the image forming processes when a diameter D of the pigment 50*a* shown in FIG. 5 is about 0.7–1.5 μm.

The pigment 50*a* having the above size may be formed by controlling a milling work time for fabricating the high-concentration ink 42*a*4. For example, there is a little difference in colors, but the pigment having the above size may be formed through a milling work for about 9–11 hours.

In order to verify another experiments, images were formed using the high-concentration ink having each size of the pigment 50*a* is 3.5 μm and 0.7 μm. When the size of the pigment 50*a* is 3.5 μm, a stripe as the flow pattern is formed in an image-formed direction. However, when the size of the pigment 50*a* is 0.7 μm, the stripe is not formed in any image.

This invention has been particularly shown and described with reference to embodiments thereof, but this is not limited to these embodiments, and it would be appreciated by those skilled in the art that changes may be made in this embodiment without departing from the principles and sprit of the invention, the scope of which is defined in the claims and their equivalents.

In particular, it will be understood by those skilled in the art that a photosensitive body having an over-coating layer having a thickness of about 7–15 μm is provided, and latent electrostatic images formed in the photosensitive body are developed using high-concentration ink having a pigment having a diameter of about 0.7–1.5 μm.

As described above, in the wet-type color image forming apparatus according to the present invention, the thickness of the over-coating layer, which is the outermost layer of the photosensitive body directly contacting the developing roller during the developing process, is thinner than that in prior art, and the size of the pigment, which is an essential composition of high-concentration ink used in the developing process, is smaller than in prior art. In addition, the efficiency of the developing agent transferred onto the photosensitive body from the developing roller is increased, and thus the hold up volume is not formed between the developing roller and the photosensitive body during the developing process, and the flow pattern such as a stripe, is not formed in a final image. In addition, the transfer efficiency of the developing agent increases, and thus the absolute amount of the developing agent used to develop the latent electrostatic images can be reduced than in prior art.

What is claimed is:

1. A method of preventing a flow pattern in a wet-type color image forming apparatus having a latent electrostatic image, the method comprising:

forming the latent electrostatic image on a photosensitive body having an outer layer having a thickness of greater than 10 μm and less than or equal to 25 μm and an inner layer below the outer layer, the inner layer comprising:

an adhesion layer, and a charge layer formed on the adhesion layer, the charge layer comprising a charge transfer layer on the adhesion layer and a charge generating layer on the charge transfer layer, the outer layer being formed on the charge generating layer; and developing the latent electrostatic image on the outer layer of the photosensitive body by using high-concentration ink supplied from a developing unit.

2. The method of claim 1, wherein the latent electrostatic image is developed using the high-concentration ink having an essential composition having a size of 0.7–1.5 μm inclusive.

3. An apparatus in a wet-type color image forming apparatus having a developing unit to develop a latent electrostatic image, comprising:

a photosensitive body having the latent electrostatic image to be developed by high-concentration ink supplied from the developing unit;

an outmost layer formed on the photosensitive body to contact the high-concentration ink, having a thickness of greater than 10 μm and less than 25 μm; and a contour layer below the outmost layer, comprising:

an adhesion layer, and a charge layer formed on the adhesion layer, the charge layer comprising a charge transfer layer on the adhesion layer and a charge generating layer on the charge transfer layer, the outmost layer being formed on the charge generating layer.

4. An apparatus in a wet-type color image forming apparatus having a developing unit to develop a latent electrostatic image, comprising:

a photosensitive body having the latent electrostatic image to be developed by high-concentration ink supplied from the developing unit, comprising:

a center body made of a solid drum, and a contour layer formed on the center body and having the electrostatic image; and an outmost layer formed on the contour layer to contact the high-concentration ink, having a thickness of greater than 10 μm and less than 25 μm, wherein the contour layer comprises:

an adhesion layer formed on the center body, and a charge layer formed on the adhesion layer, the outmost layer being formed on the charge layer, wherein the charge layer comprises:

a charge transfer layer formed on the adhesion layer, and a charge generating layer formed on the charge transfer layer, the outmost layer being formed on the charge generating layer.

5. The apparatus of claim 4, wherein the outmost layer is an over-coating layer protecting the photosensitive body.

6. The apparatus of claim 4, wherein the thickness of the outmost layer is between 10–15 μm inclusive.

7. An apparatus in a wet-type color image forming apparatus having a developing unit to develop a latent electrostatic image, comprising:

a photosensitive body having the latent electrostatic image to be developed by high-concentration ink supplied from the developing unit; and an outmost layer formed on the photosensitive body to contact the high-concentration ink, having a thickness of greater than 10 μm and less than 25 μm, wherein the developing unit comprises a container containing the high-concentration ink of about 12% toner concentration and a developing roller having a first portion immersed in the high-concentration ink and a second portion contacting the outmost layer of the photosensitive body.

8. The apparatus of claim 7, wherein the outmost layer of the photosensitive body receives an amount of the high-concentration ink in a rate of more than 130 $\mu g/cm^2$ from the developing roller when about 400V is supplied to the developing roller.

9. The apparatus of claim 7, wherein the high-concentration ink comprises a basic composition representing a corresponding color, and the basic composition comprises:

a pigment representing a corresponding color;

a free core layer formed around the pigment; and an organosol layer combining the pigment with the free core layer.

* * * * *